United States Patent [19]

Blumenthal et al.

[11] 4,094,155

[45] June 13, 1978

[54] MINE ROOF SUPPORT

[75] Inventors: Günter Blumenthal, Westerholt; Gustav Neu, Bochum; Hans-Ferdinand Bemmerl, Hern, all of Germany

[73] Assignee: Bochumer Eisenhutte Heintzmann GmbH & Co., Bochum, Germany

[21] Appl. No.: 760,949

[22] Filed: Jan. 21, 1977

[30] Foreign Application Priority Data

Feb. 3, 1976 Germany ..... 2603953

[51] Int. Cl.[2] ..... E21D 15/44

[52] U.S. Cl. ..... 61/45 D

[58] Field of Search ..... 61/45 D; 299/31–33; 91/170 MP; 248/357

[56] References Cited

FOREIGN PATENT DOCUMENTS

| | | | |
|---|---|---|---|
| 2,220,348 | 11/1973 | Germany | 61/45 D |
| 1,358,541 | 7/1974 | United Kingdom | 61/45 D |
| 262,050 | 1/1971 | U.S.S.R. | 61/45 D |
| 320,629 | 1/1972 | U.S.S.R. | 61/45 D |

*Primary Examiner*—Dennis L. Taylor

*Attorney, Agent, or Firm*—Michael J. Striker

[57] ABSTRACT

A mine roof support for an underground mine gallery comprises a sole plate adapted to rest on the floor of the mine gallery. The sole plate is connected by links to the region of the lower end of a rear shield, and the upper end of the latter is connected by pivot means to a roof shield, between opposite ends of the latter, in such a manner that a portion of the roof shield between the front end thereof and the pivoted means is considerably longer than the portion of the roof shield between the pivot means and the rear end of the roof shield. At least one extensible and collapsible prop extends between the sole plate and the portion of the roof shield which is located forwardly of the pivot means and at least one additional prop extends between the sole plate and the rear shield, so that the roof shield may be pressed against the roof of the mine gallery and be shifted relative to the mine face.

18 Claims, 12 Drawing Figures

FIG. 3a
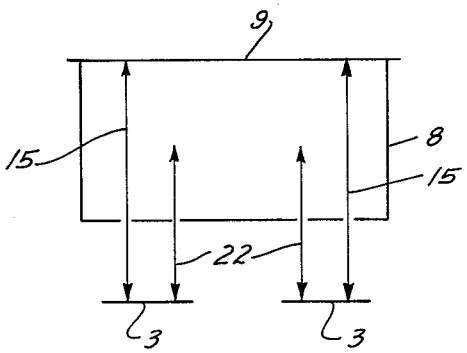
FIG. 3b
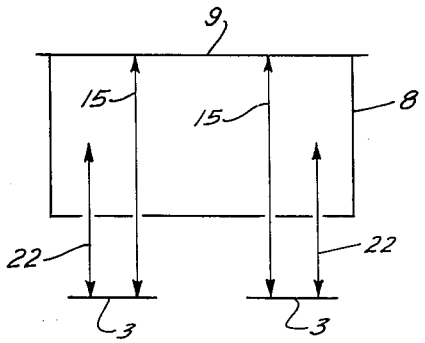
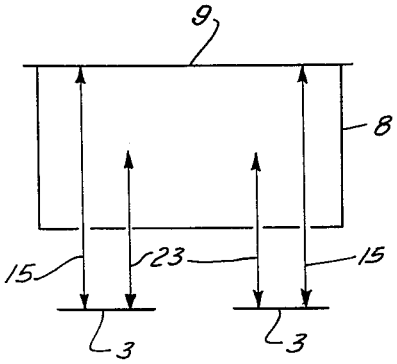
FIG. 4a
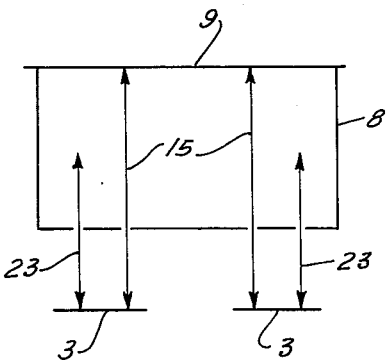
FIG. 4b
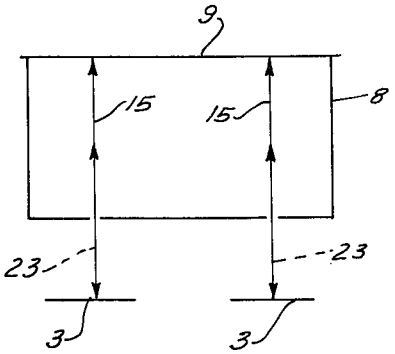
FIG. 4c
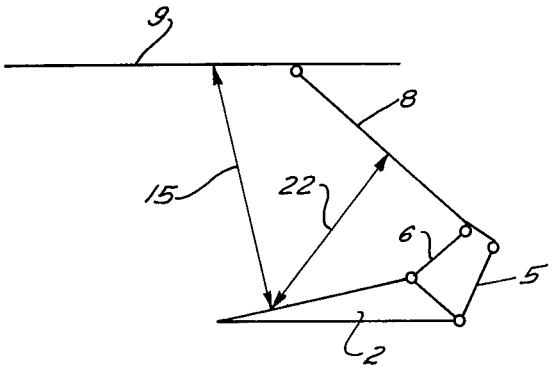
FIG. 7

MINE ROOF SUPPORT

BACKGROUND OF THE INVENTION

The present invention relates to a mine roof support for underground mine galleries, which comprises a sole plate adapted to rest on the floor of the mine gallery, a rear shield connected in the region of the lower end thereof by link means to the end of the sole plate which is directed away from the mine face, and which is connected by pivot means to a roof shield, intermediate the ends of the latter, in which the rear shield is at least indirectly supported by an extensible and collapsible prop.

The sole plate may be constituted by a single integral member or, for instance in order to adapt itself to an uneven floor of the mine gallery, it may also be constructed of two parallel elongated members extending in the longitudinal direction of the mine gallery and which are connected to each other for movement relative to each other. The rear shield and the roof shield have large areas and may be constructed of a plurality of parts. The link means between the rear shield and the sole plate are constructed in such a manner that the front edge of the roof shield, directed toward the mine face, may be moved closely adjacent to the latter so that mine roof portions which are newly exposed by a mining machine may be properly supported.

At least one, but usually two hydraulically operated props are provided in order to apply a supporting force for the roof and the piston rods of the props are connected to the rear shield, or the roof shield, respectively directly to the pivot means which connect the rear shield with the roof shield. The pivot means which connect the upper end of the rear shield to the roof shield is usually provided substantially midway between the opposite ends of the roof shield. However, a construction is also known in which the distance of the front end of the roof shield from the pivot means is slightly longer than the distance between the pivot means and the rear end of the roof shield.

Even though the above-described mine roof supports have proven satisfactory in principle, they have certain shortcomings, if the loading thereof by the roof of the mine gallery will produce unusual stresses on the different components of the mine roof support, which thereby considerably impair the stability of the latter and the possibility of its use. This will occur especially if the load acts closely adjacent to the front edge of the roof shield. Such loads will detrimentally influence the stability of the mine roof support to an increasing extent, the farther the pivotal connection of the prop or props to the roof shield, respectively to the rear shield, is shifted away from the mine face. One sided loading of the roof shield can also be observed, especially when the mine roof support is applied to a fold or an otherwise irregular mine roof. Diagonal loading of the mine roof support, which will detrimentally effect the proper operation thereof, may also occur when the mine roof is inclined relative to the sole of the mine gallery. Situations have also to be taken into account in which the portion of the roof shield, projecting from the pivot means forwardly towards the mine face is loaded less than the portion of the roof shield which projects rearwardly from the mentioned pivot means.

The above-mentioned loadings of a mine roof support can only be controlled to a limited extent with an arrangement of the props at which only the roof shield or the rear shield is supported, respectively in which one or two props engage directly the pivot means between the roof shield and the rear shield. In all these cases the occurring loads or stresses can only be counteracted to a limited extent, because the engagement points of the props are arranged in such a manner that only one, maximally two of the possibly occurring types of loading are considered. This may result in damaging various parts of the mine roof support, with the resultant interruption of its operation. Even though it has already been tried, by mounting cylinder and piston means between the rear shield and the roof shield, to adjust the angle between the two shields, this arrangement requires additional expenditure without increasing the total supporting force of the mine roof support to thereby assure control of any of the aforementioned unusual loadings of the mine roof support.

SUMMARY OF THE INVENTION

It is an object of the present invention to provide a mine roof support of the aforementioned kind which avoids the disadvantages of such mine roof supports known in the art.

It is an additional object of the present invention to provide a mine roof support in which the stability and the total supporting force for supporting the roof of the mine gallery is greatly increased, as compared with mine roof supports known in the art.

It is a further object of the present invention to provide a mine roof support of the aforementioned kind in which the position of the roof shield may be adapted to all possible loadings thereof and in which the front edge of the roof shield may always be held closely adjacent to the mine face.

With these and other objects in view, which will become apparent as the description proceeds, the mine roof support according to the present invention for an underground mine gallery mainly comprises sole plate means adapted to rest on the floor of the mine gallery, a rear shield having a lower and an upper end, link means connecting the rear shield in the region of the lower end thereof to the sole plate means, a roof shield having a front end directed toward the face of the mine gallery and an opposite rear end, pivot means connecting the roof shield intermediate the ends thereof to the upper end of the rear shield, with the portion of the roof shield between the pivot means and the front end thereof considerably longer than the portion between the pivot means and the opposite rear end of the roof shield, at least one extensible and collapsible prop means between the sole plate means and the portion of the roof shield which is located forwardly of the pivot means, and at least one additional extensible and collapsible prop means between the sole plate and the rear shield.

The term "considerably longer" is to be understood as meaning that the relationship of the portion of the roof shield which extends forwardly from the pivot means thereof to the length of the portion of the roof shield extending rearwardly of the pivot means thereof is about 3:1 to 4:1.

In accordance with the construction of the mine roof support of the present invention it is therefore possible to apply to the mine roof, besides the supporting force which is provided by the prop between the sole plate and the portion of the roof shield forwardly of the pivot means, an additional supporting force which is provided by the prop means extending between the rear shield and the sole plate means. This is possible because now the additional supporting force, which is provided by the prop means connected to the rear shield, will act on a surface of the roof shield. This will assure that the stability of the mine roof support is greatly increased so that also the above-mentioned extreme loadings, such as spot loading in the region of the front edge of the roof shield, one sided loading of the roof shield, diagonal loading, as well as extreme loading of the roof shield rearwardly of the pivot means, can be controlled in a very satisfactory manner.

By the arrangement of at least one prop means between the sole plate and the portion of the roof shield extending forwardly of the pivot means and at least one additional prop means between the sole plate and the rear shield, the total supporting force of the mine roof support is not only increased to a considerable extent and the stability thereof improved, as compared with such mine roof supports known in the art, but it is also possible to use one of the prop means while holding the other prop means at a fixed length to properly adjust the roof shield. For instance, by extending or collapsing the prop means between the sole plate and the portion of the roof shield forwardly of the pivot means, it is possible to tilt the roof shield about the point at which the upper end of the rear shield is pivoted to the roof shield, or by extending or collapsing of the prop means between the sole plate means and the rear shield, while holding the other prop means at a fixed length, it is possible to tilt the roof shield about a pivot point at which the roof shield is connected to its supporting prop means. The operator has therefore the possibility to apply an additional supporting force to that portion of the mine roof support which is subjected to increased loading by the mine roof. The prop means in the arrangement according to the present invention has therefore two functions, one function serves to increase the total supporting force, whereas the other function permits the adjustment of the roof shield relative to the rear shield.

According to a further preferred characteristic of the present invention, the resultant of the force of the prop means acting on the roof shield and that of the force of the prop means acting on the rear shield, acts on a region of the roof shield which is located between the pivot means and the point at which the roof shield supporting prop means is connected to the roof shield, and in which the median distance of the aforementioned region from the rear end of the roof shield is at least half or substantially equal to that from the front end.

In such an arrangement the supporting force of the prop means between the sole plate and the portion of the roof shield located forwardly of the pivot means may be equal or larger than the supporting force provided by the prop means between the sole plate means and the rear shield. The prop means between the sole plate and the portion of the roof shield located forwardly of the pivot means is preferably inclined towards the mine face. However, this prop means may also extend substantially vertically, for instance if the mine roof support is used in a mine gallery having a considerable height. Essential, however, is that the resultant of the supporting forces provided by the prop means acts at a point of the roof shield, in which the relationship of the distance of this point from the front edge of the roof shield to the distance of this point to the rer edge thereof is 1:1 or smaller than 2:1. Thereby, an optimal stability of the mine roof support is obtained, which will properly satisfy all possible loadings of the mine roof support.

In a preferred form of construction according to the present invention, the mine roof support will include two transversely spaced prop means between the sole plate means and the roof shield, each pivotally connected at one end to the sole plate and at the other end to the portion of the roof shield located between the front end thereof and the pivot means and each of the two prop means extending forwardly inclined from the one to the other end thereof, whereas a single prop means located substantially midways between the two transversely spaced prop means is provided between the sole plate means and the rear shield, extending inclined in the direction opposite to that of the two transversely spaced prop means, and pivotally connected at one end to the sole plate means and at the other end to the rear shield, with the one end of the additional prop means located forwardly of the pivotal connections of the two transversely spaced prop means to the sole plate means.

If in such a construction the sole plate means comprises two separate elongated members, which extend parallel to each other towards the mine face, and a bridging member extending transverse to the elongated members and pivotally connected at the opposite ends thereto, than the two transversely spaced prop means are pivotally connected at the lower ends thereof respectively to the elongated members, whereas the one additional prop means is pivotally connected at the lower end thereof to the bridging member. This will result in a substantially cross-shaped arrangement of the prop means, if the mine roof support is viewed from the sole thereof. The inclination of the prop means which supports the rear shield is thereby chosen in such a manner that the longitudinal axis of this prop means is, when the mine roof support is used in a mine gallery of medium height, substantially normal to the longitudinal axis of the rear shield. In this way it is possible to apply the supporting force of this prop means in an advantageous manner to the rear shield when the mine roof support is used in a mine gallery of small or large height. This will further assure easy access to the prop means and the elements for their operation.

According to another embodiment of the present invention, two transversely spaced prop means are provided between the sole plate means and the roof shield, each pivotally connected at one end to the sole plate means and at the other end of the portion of the roof shield located between the front end thereof and the pivot means, in which each of the two prop means extend forwardly inclined from the one to the other end thereof, and wherein also two transversely spaced additional prop means are provided between the sole plate means and the rear shield, both extending inclined in a direction opposite to that of the prop means between the sole plate means and the roof shield, and each pivotally connected at one end to the sole plate means and at the other end to the rear shield. In such a construction, the pivotal connections of the two transversely spaced additional prop means to the sole plate means may be located forwardly of the pivotal connections of the two first-mentioned transversely spaced prop means to the sole plate means, or the pivotal connections of the two transversely spaced additional prop means to the sole plate means may be located laterally of the pivotal connection of the other two transversely spaced prop means, or the pivotal connection of the two transversely spaced additional prop means to the sole plate means may be located rearwardly of the pivotal connection of the two other prop means to the sole plate means.

The axes of the transversely spaced prop means between the sole plate means and the roof shield and the axes of the two additional transversely spaced prop means are preferably located in vertical planes parallel and symmetrically arranged to a vertical plane of symmetry of the mine roof support and in such an arrangement the vertical planes at which the axes of the two transversely spaced additional prop means are located may be arranged between the planes in which the axes of the other two prop means are located, or the vertical planes at which the axes of the two additional prop means are located may be arranged outside of the planes in which the two other prop means are located, or the axes of the two transversely spaced additional prop means may be located in the same planes as the axes of the other two prop means.

Depending where the lower ends of the additional prop means which support the rear shield are located relative to the lower ends of the two other prop means, it can be of advantage that the prop means which support the rear shield converge or diverge relative to each other in direction toward the rear shield.

If in such a form of construction, the prop means which support the rear shield are arranged outwardly of the other two prop means, then it is possible to apply an additional supporting force to the roof shield in such a manner that especially lateral loadings of the roof shield may be properly controlled. Also directional functions may be applied. If, however, the prop means which support the rear shield diverge in direction toward the latter, whereby they may engage the rear shield centrally at one point, then a three-point arrangement may be obtained in connection with the two other prop means, which will lead to a static balancing of the supporting point on the rear shield, respectively on the portion of the roof shield located forwardly of the pivot means. It is also possible to incline the prop means which support the portion of the roof shield located forwardly of the pivot means in outward direction and to incline the prop means which support the rear shield in inward direction.

In order to permit the operator to adapt the mine roof support to the physical conditions of the mine gallery, it is also possible in accordance with the present invention, to admit or discharge pressure fluid simultaneously from all of the prop means, or individually while holding one or all of the other prop means at a fixed length.

In this connection it is also advantageous to provide in the cylinder spaces below the piston of the prop means which support the roof shield, as well as in the cylinder spaces to opposite sides of the piston in the prop means which support the rear shield, check valves and overpressure valves.

Since during loading of the prop means supporting the roof shield the pistons therein will be biased to move in downward direction, check valves, respectively overpressure valves are necessary only for the cylinder spaces of the prop means below the pistons therein, whereas for the prop means which support the rear shield it is necessary to provide such check valves and overpressure valves for the cylinder compartments to opposite sides of the pistons therein.

The link means which connect the rear shield in the region of the lower end thereof with the sole plate means preferably comprise two links spaced in the longitudinal direction of the mine roof support from each other and each pivotally connected at opposite ends to the region of the lower end of the rear shield and the sole plate means, respectively, to form a so-called lemniscate guide arrangement, and stop means are provided on the sole plate means cooperating with one of the links for limiting forward tilting movement thereof.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 3*a* is a front view of the embodiment in FIG. 3;

FIG. 3*b* is a modified front view of the embodiment shown in FIG. 3;

FIGS. 4*a*–4*c* are schematic front views of various modifications of the embodiment shown in FIG. 4;

FIG. 7 is a schematic side view of a sixth embodiment.

DESCRIPTION OF THE PREFERRED EMBODIMENTS

Figure 1:
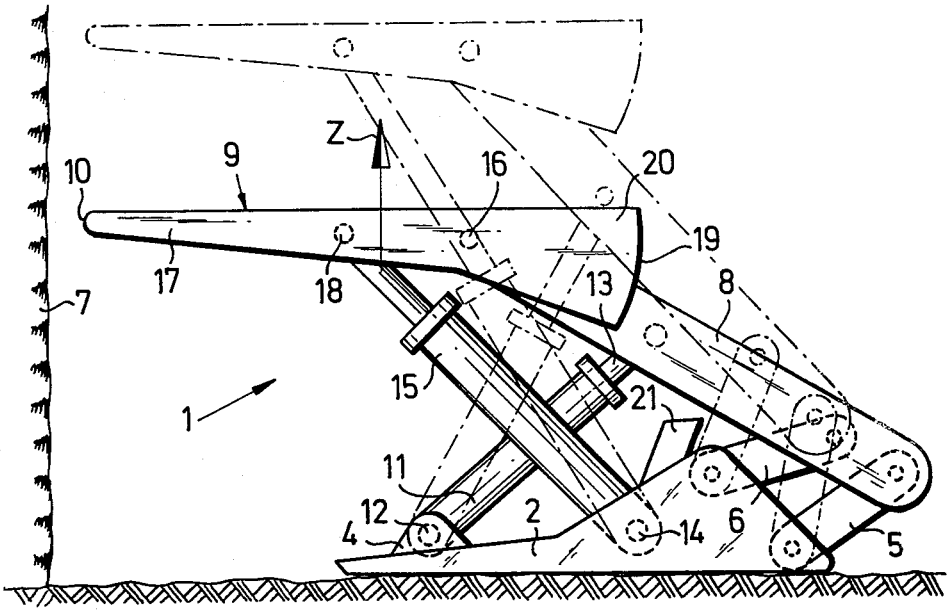
FIG. 1 is a side view of a first embodiment of the mine roof support according to the present invention, showing in full-lines the mine roof support adjusted for supporting a roof in a mine gallery of low height and in dash-dotted lines adjusted for supporting the roof in a mine gallery of greater height.
Figure 2:
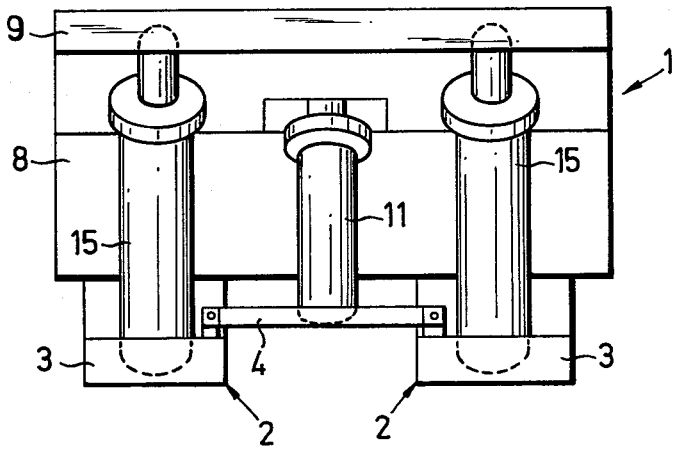
FIG. 2 is a front view of the mine support shown in FIG. 1, in the position as shown in full-lines in FIG. 1.

Referring now to the drawing, and more specifically to FIGS. 1 and 2 of the same, it will be seen that the mine roof support according to the present invention may comprise sole plate means 2 adapted to rest on the floor of an underground mine gallery and the sole plate means 2 may comprise, as shown in FIG. 2, two parallel transversely spaced elongated members 3. As shown in FIG. 2, the parallel elongated members 3 are connected to each other by a bridging member 4, pivotally connected at opposite ends to the members 3, respectively.

The sole plate means 2 may be moved in a known manner, not forming part of the present invention and not illustrated in the drawing, by advancing means connected thereto and located between the mine face 7 and the sole plate means 2, toward the mine face.

Two links 5 and 6 are pivotally connected at their lower ends at different elevations and spaced from each other to the region of the rear end of the sole plate means 2 and the upper ends of the links 5 and 6 are pivotally connected to the region of the rear end of a rear shield 8 which extends upwardly inclined toward the mine face 7. Pivot means 16 connect the upper end of the rear shield 8 to a roof shield 9, intermediate the ends of the latter. The links 5, 6 are arranged relative to the rear shield 8 and the sole plate means 2, and the length of the links is chosen in such a manner so that the front edge 10 of the roof shield 9 may be moved in vertical direction through a relatively large distance substantially parallel to the mine face 7.

The rear shield 8 is supported intermediate its ends by a hydraulically operable extensible and collapsible prop 11. The lower end of the prop 11 is pivotally supported at 12 on the bridging member 4, which connects the two members 3 of the sole plate means 2. The piston rod 13 of the prop 11 is pivotally supported at its upper end to the rear shield 8, substantially at the upper third of the latter.

The roof shield 9 is supported by two parallel hydraulically operated collapsible and extensible props 15 extending parallel to each other, with the lower ends pivotally connected at 14 to the two elongated members 3 of the sole plate means 2, respectively, and the two props 15 extend forwardly inclined from their lower ends and are pivotally connected at 18 to the portion 17 of the roof shield 9 which extends forwardly from the pivot means 16 toward the mine face 7. As shown in FIG. 1, the props 15, which support the roof shield 9, cross the prop 11 supporting the rear shield 8.

The points of pivotal connection 18 of the props 15 to the portion 17 of the roof shield 9 is chosen in such a manner that the resultant Z, of the supporting force of the props 15 acting on the roof shield 9 and that of the force of the prop 11 acting on the rear shield 8, acts on a region of the roof shield 9 which is located between the pivot means 16 and the points 18, and the median distance of this region from the rear end 19 of the roof shield is at least half of that from the front end 10 thereof. The length of the portion 20 of the roof shield 9, that is the portion between the pivot means 16 and the rear end 19 of the roof shield, is about a quarter to a third of the length of the portion 17 of the roof shield, that is the portion between the pivot means 16 and the front edge 10 thereof.

As further shown in FIG. 1, stop means 21 are provided at the raised portion of the sole plate means 2, adapted to cooperate with the link 6 to limit tilting of the links 5 and 6 toward the mine face 7.

FIG. 1 shows further in dash-dotted lines the roof shield 9 in a raised position, and as can be seen from FIG. 1, the arrangement of the links 5 and 6 permits to maintain the front edge 10 of the roof shield 9 close to the mine face 7 during raising of the roof shield from the position shown in full lines in FIG. 1 to the position shown in dash-dotted lines.

Figure 3:
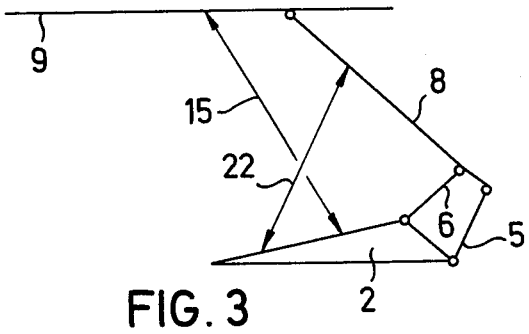
FIG. 3 is a schematic side view of a second embodiment of the mine roof support of the mine roof support according to the present invention.

FIGS. 3 and 3*a* schematically illustrate a second embodiment of a mine roof support according to the present invention in which not only the roof shield 9, but also the rear shield 3 is supported by two props 15 and 22, respectively. The props 15 and 22 cross each other, as seen in the side view of FIG. 3 and as shown in the schematic front view 3*a*, the props 22 supporting the rear shield 8 are located between the two props 15 which support the roof shield 9. The center lines of the props 22 and 15 are thereby located in planes which are parallel and mirror-symmetrical to a vertical longitudinal center plane of the mine roof support. FIG. 3*b* shows a front view of a modification in which the props 22, supporting the rear shield 8, are located outwardly of the props 15 supporting the roof shield 9.

Figure 4:
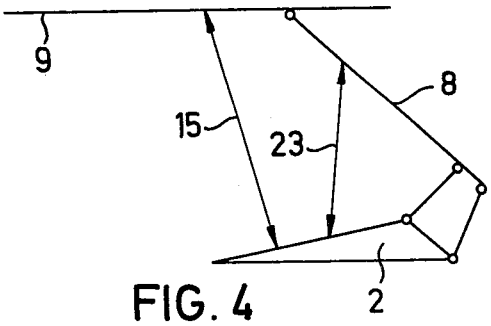
FIG. 4 is a schematic side view of a third embodiment.

FIG. 4 schematically illustrates a further embodiment of the mine roof support according to the present invention in which the roof shield 9 is supported by two props 15 and the rear shield 8 by two props 23, but in which the lower ends of the props 23 which are pivotally connected to the sole plate means 2, are located rearwardly of the lower ends of the props 15. The props 15 are again forwardly inclined from the lower ends thereof and the props 23 rearwardly inclined from the lower ends thereof. The props 23 may in this case be located between the props 15, as shown in FIG. 4*a*, or the props 23 may be located outside of the props 15 as shown in FIG. 4*b* or, finally, the props 23 may be respectively located in the same parallel planes extending parallel and mirror-symmetrically to a central vertical plane of symmetry of the mine roof support, as the props 15.

Figure 5:
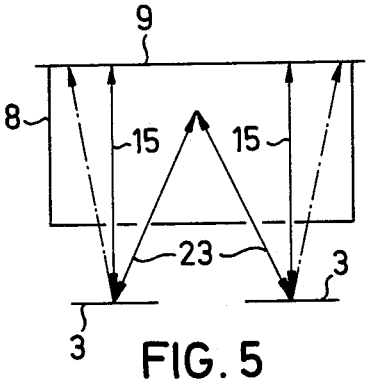
FIG. 5 is a schematic front view of a fourth embodiment.

FIG. 5 shows a further embodiment in a schematic front view, and as shown therein, the props 23 which support the rear shield 8 converge from the lower ends, pivotally connected to the members 3 of the sole plate means 2, in such a manner that they engage the rear shield 8 substantially central thereof at a common point. The props 15, which support the roof shield 9, extend parallel to each other, or as indicated in dashed-dotted lines these props 15 may also diverge outwardly from the lower towards the upper ends thereof.

Figure 6:
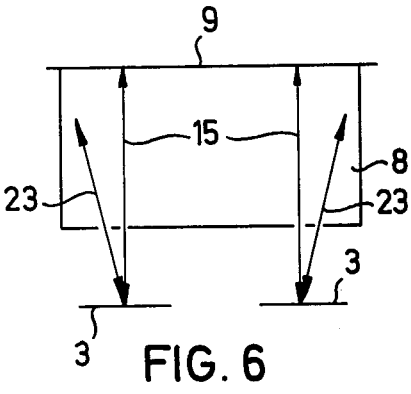
FIG. 6 is a schematic front view of a fifth embodiment.

In the embodiment shown in FIG. 6, the props 23, which support the rear shield 8, diverge from the lower towards the upper ends thereof, whereas the props 15 which support the roof shield 9 extend parallel to each other in planes mirror-symmetrically arranged with respect to a vertical plane of symmetry of the mine roof support.

Finally, FIG. 7 schematically illustrates in a side view a further embodiment of a mine roof support according to the present invention, in which the lower ends of the props 15, which support the roof shield 9, and the lower ends of the props 22, which support the rear shield 8, are located in a common transverse plane, whereby the props 22 may be arranged inwardly of the props 15 as shown in FIG. 3*a*, or outwardly thereof as shown in FIG. 3*b*.

It will be understood that each of the elements described above, or two or more together, may also find a useful application in other types of mine roof supports differing from the types described above.

While the invention has been illustrated and described as embodied in a mine roof support for an underground mine gallery, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A mine roof support for an underground mine gallery comprising elongated sole plate means integral in the longitudinal direction thereof and adapted to engage the floor of a mine gallery; a rear shield having a lower and an upper end; link means connecting said rear shield in the region of the lower end thereof to said sole plate means; a roof shield having a front end adapted to be directed towards the face of the mine gallery and an opposite rear end; pivot means connecting said roof shield intermediate the ends thereof to the upper end of said rear shield, with a portion of said roof shield between said pivot means and said front end thereof considerably longer than the portion between said pivot means and the opposite rear end of said roof shield; at least one extensible and collapsible prop means between said sole plate means and the portion of said roof shield means which is located forwardly of said pivot means; and at least one additional extensible and collapsible prop means between said sole plate means and said rear shield means.

2. A mine roof support as defined in claim 1, wherein said first-mentioned prop means is pivotally connected to said roof shield at a point located between said pivot means and said front end of said roof shield, so that the resultant of the force of the prop means acting on the roof shield and that of the force of said prop means acting on said rear shield acts on a region of said roof shield which is located between said pivot means and said point and in which the median distance of said region from said rear end of said roof shield is at least half of that from the front end.

3. A mine roof support as defined in claim 2, wherein said median distance of said region from said rear end of said roof shield is substantially equal to that from said front end.

4. A mine roof support as defined in claim 1, wherein two transversely spaced prop means are provided between said sole plate means and said roof shield, each pivotally connected at one end to said sole plate means and at the other end to said portion of said roof shield located between said front end thereof and said pivot means, and each of said two prop means extending forwardly inclined from said one to said other end thereof, and wherein a single additional prop means, located between said two transversely spaced prop means, is provided between said sole plate means and said rear shield, extending inclined in a direction opposite to that of said two transversely spaced prop means and pivotally connected at one end to said sole plate means and at the other end to said rear shield, said one end of said additional prop means being located forwardly of the pivotal connections of said two transversely spaced prop means to said sole plate means.

5. A mine roof support as defined in claim 4, wherein said additional prop means is located in a vertical plane of symmetry between said two transversely spaced prop means.

6. A mine roof support as defined in claim 1, wherein two transversely spaced prop means are provided between said sole plate means and said roof shield, each pivotally connected at one end to said sole plate means and at the other end to said portion of said roof shield located between said front end thereof and said pivot means and each of said two prop means extending forwardly inclined from said one to said other end thereof, and wherein two transversely spaced additional prop means are provided between said sole plate means and said rear shield, both extending inclined in a direction opposite to that of said prop means between said sole plate means and said front shield, and each pivotally connected at one end to said sole plate means and at the other end to said rear shield.

7. A mine roof support as defined in claim 6, wherein the pivotal connections of the two transversely spaced additional prop means to said sole plate means are located forwardly of the pivotal connections of said two first-mentioned transversely spaced prop means to said sole plate means.

8. A mine roof support as defined in claim 6, wherein said pivotal connections of said two transversely spaced additional prop means to said sole plate means are located laterally of the pivotal connections of the two first-mentioned transversely spaced prop means to said sole plate means.

9. A mine roof support as defined in claim 6, wherein said pivotal connections of said two transversely spaced additional prop means to said sole plate means are located rearwardly of said pivotal connections of said two first-mentioned transversely spaced prop means to said sole plate means.

10. A mine roof support as defined in claim 6, wherein the axes of said two first-mentioned transversely spaced prop means and the axes of the two additional transversely spaced prop means are located in vertical planes parallel to a vertical plane of symmetry of said mine roof support.

11. A mine roof support as defined in claim 10, wherein the vertical planes at which the axes of said two transversely spaced additional prop means are located are arranged between the planes at which said first-mentioned two transversely spaced prop means are located.

12. A mine roof support as defined in claim 10, wherein the vertical planes at which the axes of said first-mentioned two transversely spaced prop means are located are arranged between the planes at which the axes of said two additional prop means are located.

13. A mine roof support as defined in claim 10, wherein the axes of the two first-mentioned transversely spaced prop means are respectively located in the same planes as the axes of said two transversely spaced additional prop means.

14. A mine roof support as defined in claim 6, wherein the axes of said two additional transversely spaced prop means converge in the direction towards said rear shield.

15. A mine roof support as defined in claim 6, wherein the axes of the two additional transversely spaced prop means diverge in the direction towards said rear shield.

16. A mine roof support as defined in claim 1, wherein said link means comprise two links spaced in the longitudinal direction of said mine roof support from each other and each pivotally connected at opposite ends to said region of said rear shield and said sole plate means, respectively, and including stop means on said sole plate means cooperating with one of said links for limiting forward tilting movement thereof.

17. A mine roof support as defined in claim 4, wherein said sole plate means comprises two separate elongated members extending parallel to each other, and a bridging member extending transverse to said elongated members and pivotally connected at opposite ends to said members, respectively, and wherein said two transversely spaced prop means are pivotally connected at the one ends thereof to said elongated members, respectively, and said one additional prop means is pivotally connected at said one end to said bridging member.

18. A mine roof support as defined in claim 1, wherein said first mentioned prop means extends upwardly and forwardly inclined from said sole plate means and said additional prop means extends upwardly and rearwardly inclined from said sole plate means, said additional prop means being connected to said rear shield intermediate the ends of the latter.

* * * * *